United States Patent [19]

Hartness

[11] Patent Number: 4,726,167

[45] Date of Patent: Feb. 23, 1988

[54] GRID FINGER ASSEMBLIES

[75] Inventor: Robert G. Hartness, Greer, S.C.

[73] Assignee: Hartness International, Greenville, S.C.

[21] Appl. No.: 13,008

[22] Filed: Feb. 10, 1987

[51] Int. Cl.[4] ..... B65B 39/02; B65B 5/08

[52] U.S. Cl. ..... 53/248; 53/262

[58] Field of Search ..... 53/248, 247, 260, 261, 53/262, 543

[56] References Cited

U.S. PATENT DOCUMENTS

| | | | |
|---|---|---|---|
| 3,031,820 | 5/1962 | Schulze et al. | 53/247 |
| 3,057,136 | 10/1962 | Walter | 53/262 |
| 3,271,928 | 9/1966 | Wild | 53/248 |
| 3,788,034 | 1/1974 | Hartness et al. | 53/248 |
| 3,908,339 | 9/1975 | Kennedy et al. | 53/248 |
| 3,911,647 | 10/1975 | Hartness et al. | 53/248 |
| 4,044,530 | 8/1977 | Phillips | 53/248 |
| 4,075,819 | 2/1978 | Raudat et al. | 53/248 |
| 4,170,096 | 10/1979 | Wild | 53/248 |
| 4,207,721 | 6/1980 | Raudat et al. | 53/248 |
| 4,207,722 | 6/1980 | Raudat | 53/248 |
| 4,581,872 | 4/1986 | Goodell | 53/262 X |
| 4,608,804 | 9/1986 | Wild | 53/262 |

OTHER PUBLICATIONS

Drawings (one sheet) of the Hartness "Butterfly Fingers", manufactured by Hartness International, Inc., of Greenville, South Carolina.

*Primary Examiner*—Horace M. Culver

*Attorney, Agent, or Firm*—Dority & Manning, P.A.

[57] ABSTRACT

A grid finger attachment assembly attachable to a grid structure for guiding articles delivered to the grid structure from an article supply source into containers. The grid finger attachment assembly comprises an elongated grid finger, a compressible resilient member projecting from the upper end of the grid finger receiving member defines a receiving recess for receiving the upper end of the grid finger and the compressible resilient member. The grid finger receiving member has portions defining an aperture for receiving the compressible resilient member, such that upon receipt by the receiving recess of the upper end of the grid finger and the compressible resilient member, the compressible resilient member is projectable through the aperture and engageable with portions of the grid finger receiving member adjacent the aperture, for fixedly retaining the grid finger to the grid finger receiving member. The compressible resilient member may include a slot in the upper end of the grid finger, wherein the slot forms at least one projectable resilient tab portion. The grid finger receiving member includes means for compressing the compressible resilient member upon receipt of the compressible resilient member by the receiving recess.

13 Claims, 12 Drawing Figures

GRID FINGER ASSEMBLIES

BACKGROUND OF THE INVENTION

This invention relates to a grid finger assembly attachable to a grid structure for guiding articles delivered to the grid structure into compartments of containers.

Case packing machines for packing containers into compartmentalized cases typically employ conveyors for delivering containers from an upstream process to a grid structure. The grid structure generally includes partitions arranged in crossed relation to one another to form container guiding channels or compartments which correspond to the compartments in the cases which are to be packed. Upon delivery from the conveyors to the grid assembly, the containers are positioned in the compartments of the grid assembly, and the grid assembly is lowered with the containers to an empty case for loading the containers into the case, or, the empty case may be brought upwards to the grid structure, depending on the design of the particular case packing machine.

Grid structures are often provided with yieldable grid fingers which extend downwardly from the sides of the grid structure compartments for projecting into the compartments of an empty case to guide and retard the movement of the containers as the containers pass through the grid structure and into the empty case. Sometimes, the grid fingers wear or may become bent or broken such that they must be replaced. Replacement of the fingers can be a time consuming, tedious endeavor if the fingers are not designed for quick installation and removal.

Several types of finger members have been patented which are designed for easier installation and removal from a grid structure. For example, U.S. Pat. No. 3,271,928, granted to Wild for a packer grid, discloses a grid finger member having a recessed portion for receiving a spring member attached to the grid structure. Installation of a finger involves inserting the finger into a bracket attached to the grid structure to a position such that the spring engages the recessed portion of the finger. Removal of the finger involves depressing the spring such that the spring becomes disengaged from the recessed portion, thereby allowing the finger to be pulled from the bracket. U.S. Pat. No. 4,170,096, also granted to Wild, discloses another type of finger member having a longitudinal slot which engages cylindrical collars attached to the grid structure. The finger is retained to the grid structure through a releasable interference fit between the slot and the collars.

Other patented fingers are disclosed in patents having the following U.S. Pat. Nos.: 3,031,820 granted to Schulze et al.; 3,788,034 and 3,911,647 granted to Hartness et al., the present inventors; 4,044,530 granted to Phillips; and 4,075,819 and 4,207,721 granted to Raudat et al.

A problem exists with conventional grid fingers in that the grid finger attachment mechanism may have a pronounced profile or protuberances which project into the compartments of the grid structure in a manner which obstructs or inhibits the passage of or even damages the containers or the labels thereon as the containers pass through the grid structure. Such is especially significant where boxes are to be loaded into partitioned cases since the boxes must be maintained close together during packing into the case. Further, where loading rectangular containers or boxes into close-fitting partitions of a case, the grid fingers must be relatively thin for extending between the partition and the container or box being packed. Moreover, conventional grid finger attachments typically involve the use of a variety of parts, which increases the complexity of the assembly thereof.

SUMMARY OF THE INVENTION

It is therefore an object of the present invention to provide an attachment for attaching a grid finger to a grid structure, the attachment being relatively low profile to allow containers to pass freely through the grid structure in close relationship to one another.

Another object of the present invention is to provide an attachment for grid fingers which is of simple construction and which allows grid fingers to be quickly and easily installed in or removed from a grid structure.

A further object of the present invention is to provide a grid structure having a low profile attachment for grid fingers which allows grid fingers to be quickly and easily installed in and removed from a grid structure.

Yet another object of the present invention is to provide a thin grid finger which is insertable between a container and a partition of a case.

Still another object of the present invention is to provide a grid finger assembly having a replaceable finger element which minimizes damage to the surfaces of containers which pass through a grid structure.

Generally, in one form of the present invention, there is provided a grid finger attachment assembly attachable to a grid structure for guiding articles delivered to the grid structure from an article supply source into containers. The grid finger attachment assembly comprises an elongated body member having an upper end and a lower end, a compressible resilient member projecting from the elongated body member proximate the upper end of the elongated body member, and a receiving member. The receiving member defines a receiving recess for receiving the upper end of the elongated body member and the compressible resilient member. The receiving member has portions defining an aperture for receiving the compressible resilient member, such that upon receipt by the receiving recess of the upper end of the elongated body member and the compressible resilient member, the compressible resilient member is projectable through the aperture and engageable with the portions of the receiving member adjacent the aperture, for fixedly retaining the elongated body member to the receiving member.

More specifically, the compressible resilient member includes a slot in the upper end of the elongated body member, wherein the slot forms at least one projectable resilient tab portion in the upper end of the elongated body member. The receiving member also includes means for compressing the compressible resilient member upon receipt of the compressible resilient member by the receiving recess.

BRIEF DESCRIPTION OF THE DRAWINGS

The foregoing as well as other objects of the present invention will be more apparent from the following detailed description of the preferred embodiment of the invention when taken together with the accompanying drawings, in which.

DESCRIPTION OF THE PREFERRED EMBODIMENT

Figure 1:
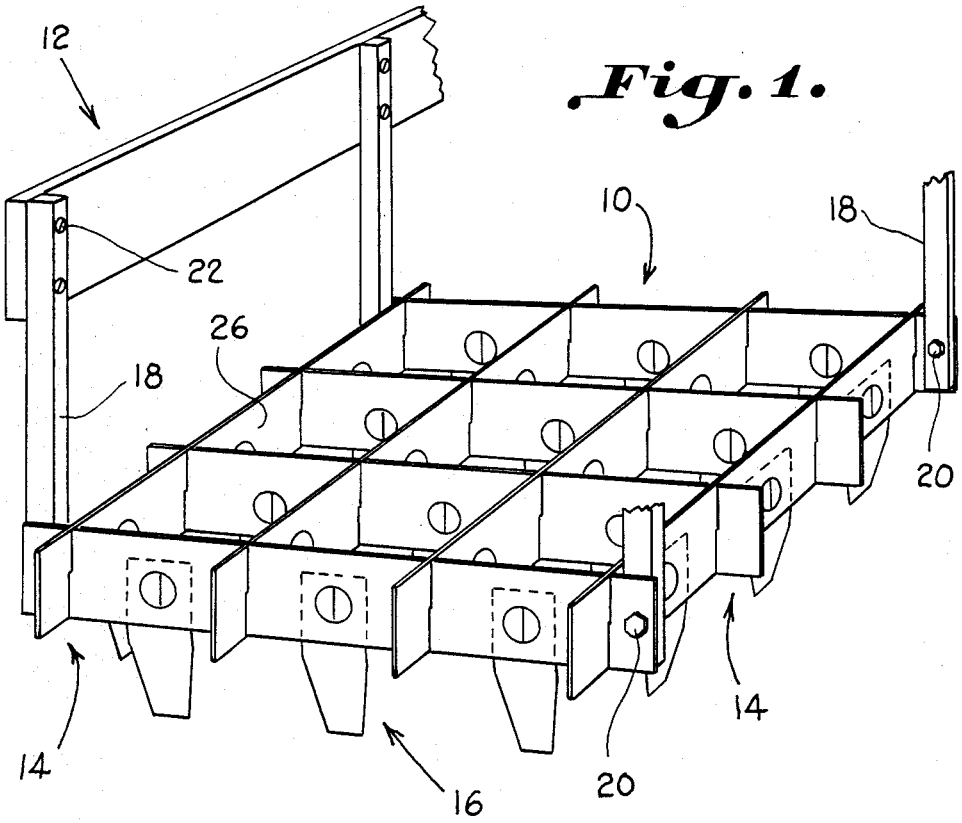
FIG. 1 is a perspective view of a grid structure having grid finger attachment assemblies constructed in accordance with the present invention.

Referring to the drawings in detail, wherein like reference characters represent like elements throughout the various views, a grid structure constructed in accordance with the present invention is designated generally by the reference character 10. Grid structure 10 is illustrated in FIG. 1 as having a support frame, generally 12, elongated partition members, generally 14, and grid fingers, generally 16.

Support frame 12 includes vertical frame members 18 attached at each corner of grid structure 10 by bolts 20, or other suitable fasteners. Vertical frame members 18 are attached at upper portions thereof to horizontal frame members 22 (a portion of only one being shown for clarity) by bolts or screws 23 or other suitable fastening means.

Grid structure 10 is attached adjacent a case packing machine infeed conveyor (not shown) for receiving containers 24 therefrom. Containers 24 are provided in compartments 26 of grid structure 10 by conventional container transfer means (not shown).

Figure 2:
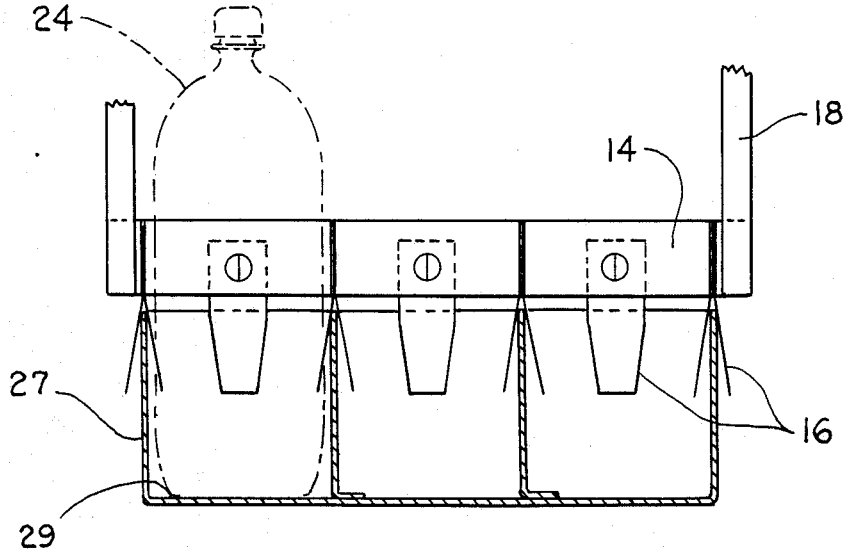
FIG. 2 is a sectional side elevational view of a grid structure having grid finger attachment assemblies constructed in accordance with the present invention.

When grid structure 10 and case 27 are adjacent one another, containers 24 pass through compartments 26 of grid structure 10 into compartments 29 of case 27, as shown in FIG. 2.

Figure 3:
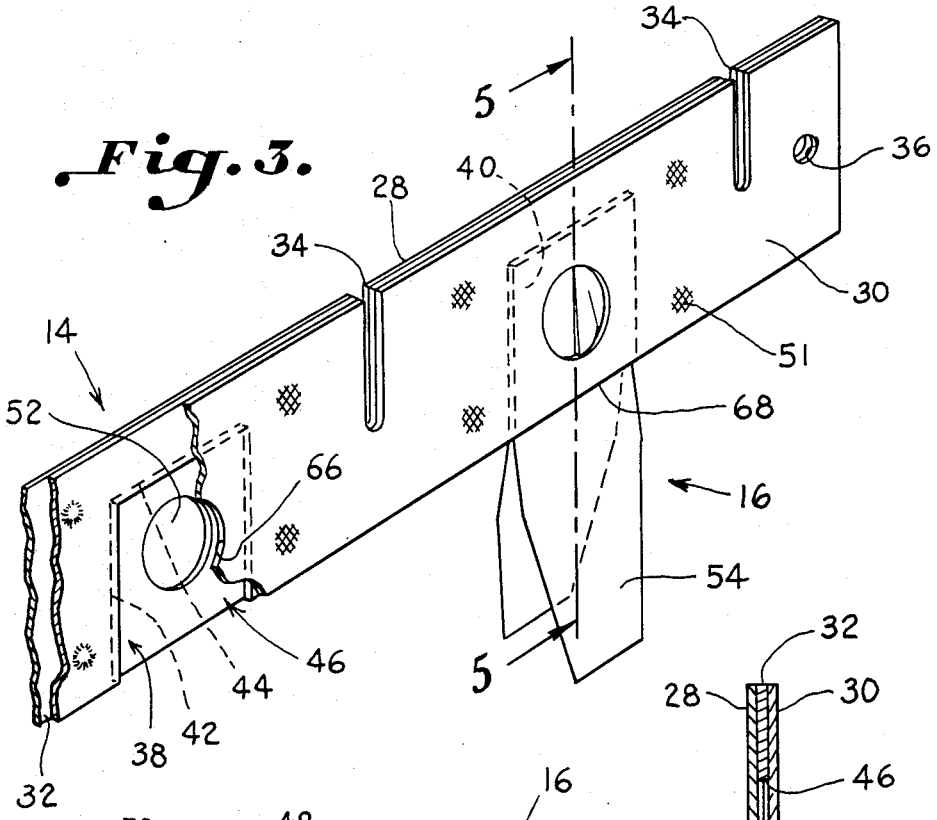
FIG. 3 is a partial perspective view of a grid finger attachment assembly constructed in accordance with the present invention.

Referring to FIG. 3, elongated partition members 14 include longitudinally extending slat members 28, 30 separated from one another by longitudinally extending spacer member 32. Slat members 28, 30 and spacer members 32 are preferably constructed of steel, although any other suitable metal, plastic, or other material could be used. Slat members 28, 30 and spacer members 32 are provided with cooperating slots 34 which receivingly engage slots 34 of perpendicularly extending slat members 28, 30 and spacer members 32 for forming grid structure 10 having compartments 26, as shown in FIG. 1. Slat members 28, 30 are also provided with holes 36 for attachment with bolts 20 to vertical frame members 18.

Spacer members 32 are provided with substantially rectangular cut-out portions 38, shown by the phantom lines in FIG. 3, for receiving the upper end 40 of grid fingers 16. Cut-out portions 38 each include side surfaces 42 and an upper surface 44 for defining a receiving recess, generally 46 for receiving the upper end 40 of grid fingers 16. Upper surface 44 of cut-out portions 38 is contactable with an upper edge 48 of grid fingers 16 for restraining upward movement of grid fingers 16 within receiving recesses 46, and side surfaces 42 are contactable with side edges 50 of grid fingers 16 for preventing lateral movement of the upper end 40 of grid fingers 16 within receiving recess 46.

Slat members 28, 30 and spacer members 32 are held together by welds 51 or by rivets, screws, bolts, or any other suitable fastening means. Elongated partition members 14, which each include slat members 28, 30 and spacer members 32, could be constructed as a one-piece unitary member by casting and/or machining processes.

Grid fingers 16 each include a lower end 54 which is angled with respect to upper end 40 such that lower end 54 of grid fingers 16 projects below compartments 26 of grid structure 10 for guiding containers 24 into compartments of case 27 disposed beneath grid structure 10, as shown in FIG. 2. In an upper end 40 of each grid finger 16 is a compressible resilient member 56 which projects outwardly from upper end 40. In the embodiment illustrated in FIG. 4, grid fingers 16 are constructed of sheet steel, and compressible resilient member 56 includes a longitudinally extending slot 58 which terminates in a semi-circular or crescent slot 60. Corners 62 are created at the intersection of longitudinally extending slot 58 and crescent slot 60. Corners 62 are bendable outwardly from upper end 40 of grid finger 16 for creating compressible engagement members 64.

Grid fingers 16 are attachable to partition members 14 through receipt of upper end 40 of grid fingers 16 by receiving recesses 46 of partition members 14. The upper end 40 of a grid finger 16 is insertible in a receiving recess 46, and upon insertion of upper end 40 into receiving recess 46, the compressible engagement member 64 of the grid finger 16 is received by aperture 52 and projects outwardly therethrough. Compressible engagement member 64 engages surfaces 66 of slat members 28, 30 which surround and define apertures 52 therein. Projection of compressible engagement member 64 through aperture 52 effectively retains grid finger 16 to partition member 14.

Upon insertion of upper end 40 of a grid finger 16 into a receiving recess 46, a border portion 68 defining the entrance to receiving recess 46 engages compressible engagement member 64 to flatten compressible engagement member 64 into upper end 40 of grid finger 16, thereby making upper end 40 of grid finger 16 substantially planar for allowing insertion of upper end 40 into receiving recess 46. As compressible engagement member 64 clears surfaces 66 surrounding aperture 52, compressible engagement member 64 springs outwardly from upper end 40 and engages with surfaces 66 as discussed above, and as shown in FIG. 5.

Grid structure 10 of the present invention accordingly provides a low profile grid finger attachment arrangement substantially free of protuberances or projections which would inhibit the passage of a container 24 therethrough. Further, grid structure 10 also provides readily changeable, thin grid fingers 16 which can be inserted between the wall of a rectangular container and a wall of a case partition member.

Figure 4:
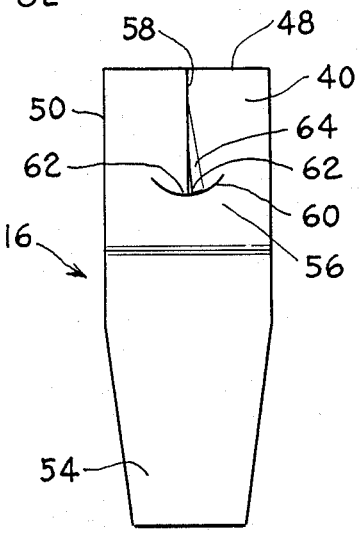
FIG. 4 is a side elevational view of a grid finger constructed in accordance with the present invention.
Figure 4A:
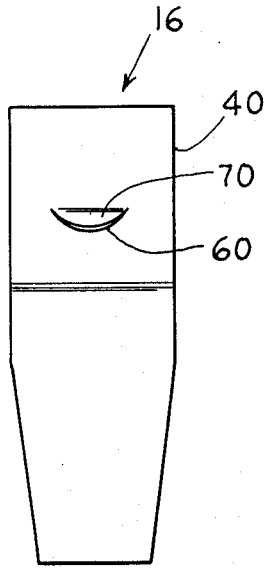
FIG. 4*a* is a side elevational view of an alternate embodiment of a grid finger constructed in accordance with the present invention.

FIG. 4A illustrates an alternate embodiment of a grid finger 16 constructed in accordance with the present invention having only crescent slot 60 instead of the longitudinally extending slot 58-crescent slot 60 combination as illustrated in FIG. 4. Use of the single crescent slot 60 in upper end 40 of grid finger 16 allows for a simplified construction of grid finger 16, while providing grid finger 16 with a compressible engagement tab 70 for engaging with surfaces 66 surrounding aperture 52 to retain grid finger 16 within receiving recess 46 of partition member 14.

Figure 5:
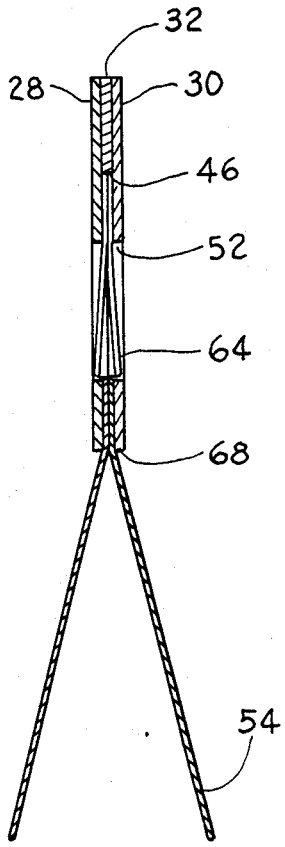
FIG. 5 is a sectional view along lines 5—5 of FIG. 3.

In removing a grid finger 16 from partition members 14, compressible resilient member 56 is depressed by hand or by another device to become substantially flush with upper end 40 of grid finger 16. Grid finger 16 may then be pulled downwardly and removed from receiving recess 46. Another grid finger 16 may then be inserted into the receiving recess 46. As shown in FIGS. 3 and 5, two grid fingers 16 may be inserted back-to-back in each receiving recess 46 for extending beneath adjacent compartments 26 of grid structure 10.

Figure 6:
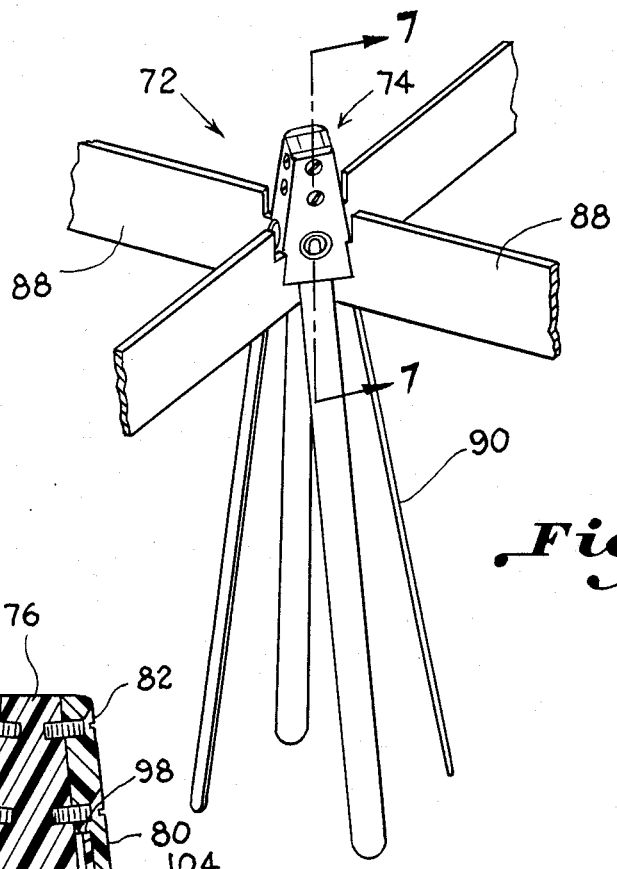
FIG. 6 is a partial perspective view of an alternate embodiment of a grid finger attachment assembly constructed in accordance with the present invention.
Figure 7:
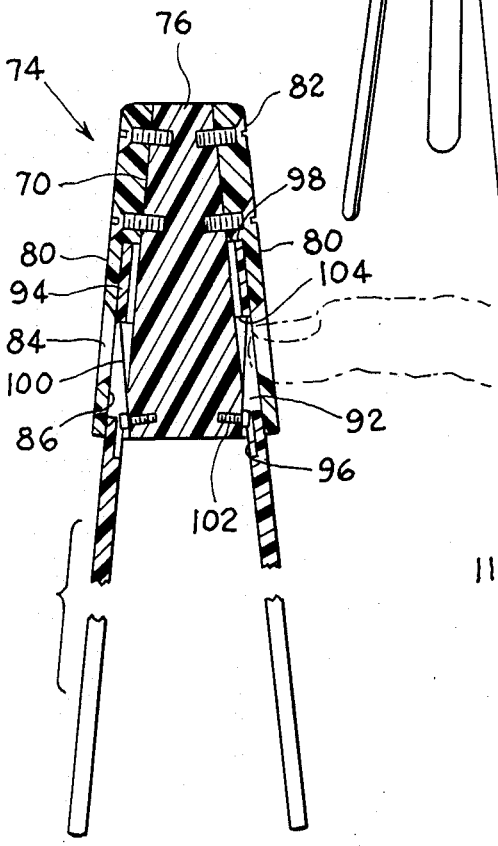
FIG. 7 is a sectional view along lines 7—7 of FIG. 6.
Figure 8:
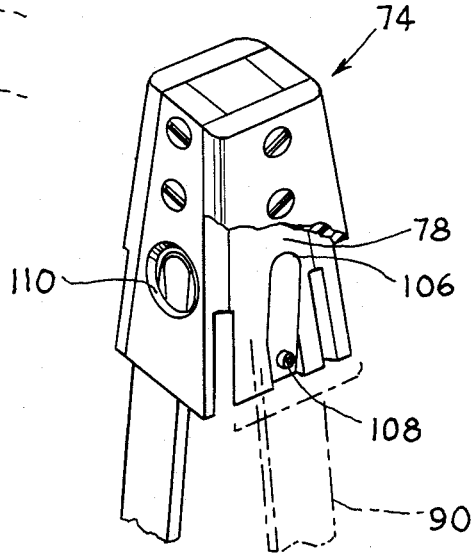
FIG. 8 is a partial perspective view, with parts cutaway, of the alternate embodiment grid finger attachment assembly shown in FIGS. 6 and 7.

FIGS. 6 through 8 illustrate an alternate embodiment of an attachment for grid fingers constructed in accordance with the present invention. Alternate embodiment grid finger attachment, generally 72 includes a receiving member 74 having a center body member 76. Center body member 76 is generally trapezoidal in profile, having four sides 78, with a retention member 80 being provided each side 78. Retention members 80 are attached to center body member 76 by screws 82, or other suitable fasteners, or made unitary with center body member 76. Defined in each retention member 80 is an aperture 84 which communicates with a recess 86 defined in each side 78 of center body member 76.

Receiving member 74 is disposed at the intersection of perpendicularly extending grid structure frame members 88 which define compartments in a grid structure (not shown). Receiving member 74 is accordingly mounted in the corner of adjacent compartments and receives downwardly extending grid fingers 90, which extend beneath the compartments defined by grid structure frame members 88. Grid fingers 90 are preferably constructed of nylon, although any other suitable metal, plastic or other material could also be used. Each grid finger 90 is provided with a slot 92 at an upper end 94 thereof. Disposed on one side of upper end 94 of grid finger 90, and communicating with slot 92, is a longitudinally extending channel 96 which extends to the upper edge 98 of grid finger 90.

A longitudinally extending spring biased tab 100 is attached within recess 86 of receiving member 74 by a screw 102 or by any other suitable fastener. It is to be understood that spring biased tab 100 could be made unitary with receiving member 74 if desired by casting and/or machining processes. Spring biased tab 100 is engageable with slot 92 of grid finger 90.

When a grid finger 90 is to be provided receiving member 74, upper end 94 of the grid finger 90 is inserted within recess 86 of receiving member 74 such that spring biased tab 100 engages surfaces 104 which define slot 92 in upper end 94 of the grid finger 90. Spring biased tab 100 is flattened down to center body member 76 as upper end 94 of grid finger 90 is inserted into recess 86, and remains flattened down until slot 92 clears the end 106 of spring biased tab 100, upon which spring biased tab 100 moves outwardly to engage surface 104 defining slot 92. The engagement of spring biased tab 100 with surfaces 104 surrounding slot 92 securely retains grid finger 90 to receiving member 74.

When it is desired to remove a grid finger 90 from receiving member 74, spring biased tab 100 is pushed inwardly towards center body member 76 by using a finger, as shown in phantom in FIG. 7, or some suitable instrument such that spring biased tab 100 clears surfaces 104 surrounding slot 92. Grid finger 90 may then be pulled downwardly and removed from receiving member 74. Channel 96 is provided in upper end 94 of grid finger 90 for receiving the head 108 of screw 102, thereby allowing upper end 94 of grid finger 90 to slidingly move within and without of receiving member 74.

Alternate embodiment grid finger attachment 72 can also be used to mount grid fingers 16 in the corners of grid structure compartments, upon removal of spring biased tabs 100 and screws 102 from center body member 76 of receiving member 74. Compressible resilient member 56 of grid finger 16 would then be engageable with surfaces 110 around aperture 84 of retention members 80 for retaining grid fingers 16 to receiving members 74. The installation and removal of grid fingers 16 from receiving member 74 would be accomplished similarly as with the installation and removal of grid fingers 16 from partition members 14.

Figure 9:
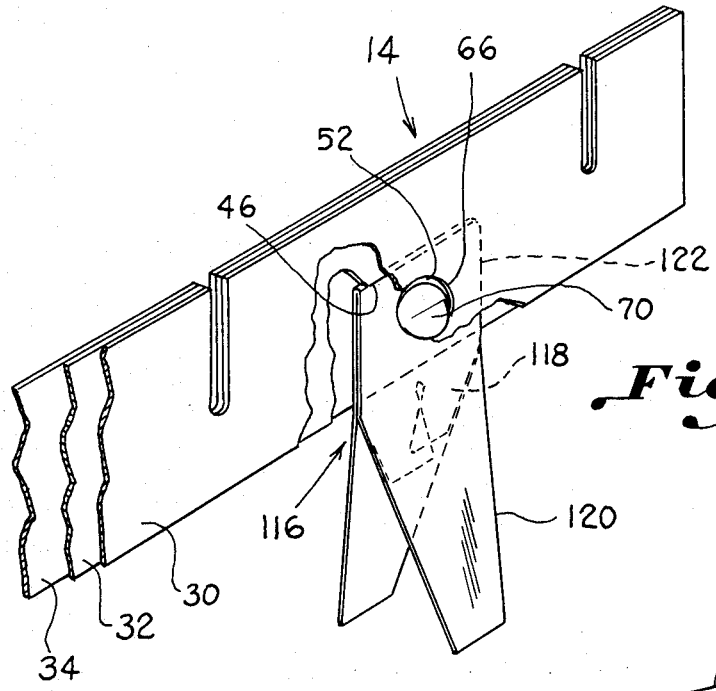
FIG. 9 is a perspective view, with parts cut away, of an alternate embodiment grid finger assembly constructed in accordance with the present invention.
Figure 10:
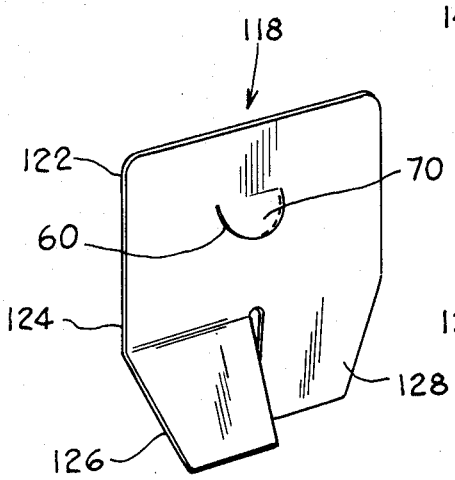
FIG. 10 is a perspective view of a grid finger biasing element of the alternate embodiment grid finger assembly shown in FIG. 9.
Figure 11:
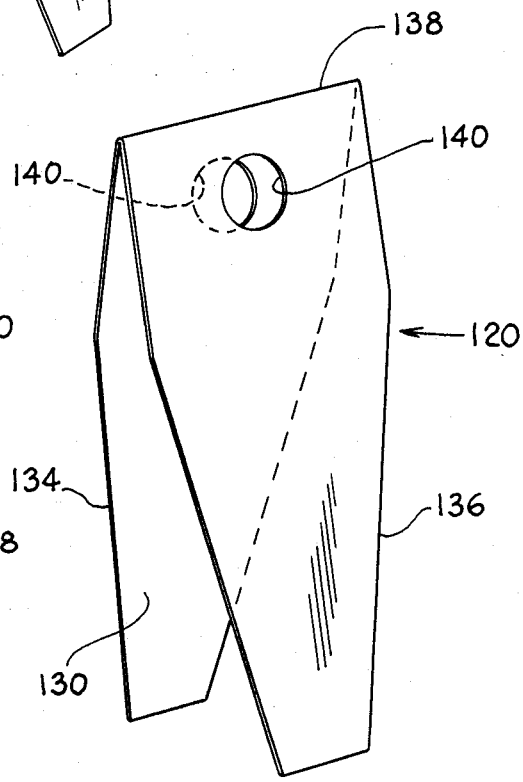
FIG. 11 is a perspective view of a grid finger element of the alternate embodiment grid finger assembly shown in FIG. 9.

FIGS. 9 through 11 illustrate a further alternate embodiment of a grid finger attachment, generally 116, constructed in accordance with the present invention. Grid finger attachment 116 includes a grid finger biasing element 118 insertable within a flexible, two-legged grid finger element 120. An upper end 122 of grid finger biasing element 116 is similar to upper end 40 of grid finger 16 illustrated in FIG. 4A and includes a single crescent slot 60 which provides biasing element 118 with a compressible engagement tab 70. Grid finger attachment 116 is insertable into a receiving recess 46 similarly as is grid finger 16. As shown in FIG. 9, compressible engagement tab 70 is engageable with surfaces 66 surrounding aperture 52 defined in partition member 14 for retaining biasing element 118 and grid finger element 120 within receiving recess 46 of partition member 14.

Extending from a lower end 124 of biasing element 118 are two spaced-apart, downwardly extending projections 126, 128. Projections 126, 128 project outwardly in opposite direction from one another, as shown in FIG. 10, and are engageable with inner surfaces 130 of grid finger element legs 134, 136 to bias legs 134, 136 outwardly, away from one another.

Legs 134, 136 of grid finger element 120 are joined together at an upper end 138 thereof and are preferably constructed from a unitary piece of a flexible, slick-surfaced plastic, such as Mylar, a polyester sold by DuPont Corp. of Wilmington, Del., although any other suitable material could be used. Legs 134, 136 are each provided with an aperture 140 which corresponds to both aperture 52 of partition member 14 and compressible engagement tab 70.

Because grid finger element 120 is preferably constructed of flexible, slick-surfaced plastic, grid finger element 120 readily accommodates, without harm thereto, containers which have delicate surfaces. Such containers may be constructed of glass, plastic, or metal and may include labels which are easily torn or otherwise damaged. Further, box containers, especially those having decorative surfaces, can be accommodated by grid finger elements 120 with reduced damage occurring thereto.

Grid finger elements 120 are pre-bent in a substantially doubled-over configuration before insertion into receiving recess 46. Since most of the force delivered to grid finger elements 120 by containers passing through a grid structure is directed along the longitudinal axis thereof, bending forces about upper end 138 of grid finger elements 120 are minimized, ensuring a longer life for grid finger elements 120.

Replacement of a grid finger element 120 is accomplished by depressing compressible engagement tab 70 of biasing element 118 such that compressible engagement tab 70 clears aperture 52, making biasing element 118 and grid finger element 120 removable from receiving recess 46. After removing biasing element 118 from grid finger element 120, biasing element 118 is inserted between legs 134, 136 of a new grid finger element 120, and both biasing element 118 and new grid finger element 120 are re-inserted into receiving recess 46.

While a preferred embodiment of the invention has been described using specific terms, such description is for illustrative purposes only, and it is to be understood that changes and variations may be made without departing from the spirit or scope of the following claims.

What is claimed is:

1. A grid finger assembly receivable in an opening of a grid structure for guiding articles delivered to the grid structure from an article supply source into containers, the grid finger assembly comprising:

an elongated body member having an upper end receivable in the opening of the grid structure; and a compressible resilient member projecting from said elongated body member proximate said upper end of said elongated body member, said compressible resilient member being receivable in and projectable through the opening of the grid structure, such that upon receipt by the grid structure of said upper end of said elongated body member and said compressible resilient member, said compressible resilient member projects through the opening for fixedly retaining said elongated body member to the grid structure.

2. A grid finger assembly as set forth in claim 1, wherein said compressible resilient member includes a slot in said upper end of said elongated body member, said slot forming at least one projectable resilient tab portion in said upper end of said elongated body member.

3. A grid finger assembly as set forth in claim 1, wherein said compressible resilient member includes a longitudinal slot and a substantially semi-circular slot in said upper end of said elongated body portion, said longitudinal slot terminating into said substantially semi-circular slot, thereby creating at least one projectable resilient corner portion in said upper end of said elongated body member.

4. A grid finger assembly as set forth in claim 1, wherein said lower end of said elongated body member is inclined relative to said upper end of said elongated body member.

5. A grid finger assembly as set forth in claim 1, further comprising:

at least one downwardly extending, outwardly projecting member attached to said elongated body member;

a grid finger element having an upper end, said elongated body member being receivable adjacent said upper end of said grid finger element; and at least one leg extending from said upper end of said grid finger element, said at least one leg having a lower end, said at least one downwardly extending, outwardly projecting member of said elongated body member being contactable with said at least one leg upon receipt of said elongated body member adjacent said grid finger element for biasing said lower end of said at least one leg outwardly with respect to said elongated body member.

6. A grid finger attachment assembly attachable to a grid structure for guiding articles delivered to the grid structure from an article supply source into containers, the grid finger attachment assembly comprising:

an elongated body member having an upper end and a lower end;

a compressible resilient member projecting from said elongated body member proximate said upper end of said elongated body member, said compressible resilient member including a slot in said upper end of said elongated body member, said slot forming at least one projectable resilient tab portion in said upper end of said elongated body member; and a receiving member defining a receiving recess for receiving said upper end of said elongated body member and said compressible resilient member; said receiving member also defining an aperture for receiving said compressible resilient member, such that upon receipt by said receiving recess of said upper end of said elongated body member and said compressible resilient member, said compressible resilient member is projectable through said aperture and engageable with portions of said receiving member adjacent said aperture for fixedly retaining said elongated body member to said receiving member.

7. A grid finger attachment assembly as set forth in claim 6, wherein said receiving member includes means for compressing said compressible member upon receipt of said compressible resilient member by said receiving recess.

8. A grid structure for delivering articles from an article supply source to compartments in containers, the grid structure comprising:

a plurality of partitions attached to one another to define a plurality of passageways therebetween;

a plurality of grid finger attachment assemblies attached to said plurality of partitions adjacent said plurality of passageways, each of said plurality of grid finger attachment assemblies including:

an elongated body member having an upper end and a lower end;

a compressible resilient member projecting from said elongated body member proximate said upper end of said elongated body member; and a receiving member defining a receiving recess for receiving said upper end of said elongated body member and said compressible resilient member; said receiving member having portions defining an aperture for receiving said compressible resilient member, such that upon receipt by said receiving recess of said upper end of said elongated body member and said compressible resilient member, said compressible resilient member is projectable through said aperture and engageable with said portions of said receiving member adjacent said aperture for fixedly retaining said elongated body member to said receiving member.

9. A grid structure as set forth in claim 8, wherein said grid finger attachment assembly further comprises means for compressing said compressible resilient member upon receipt of said compressible resilient member by said receiving recess.

10. A grid finger attachment assembly attachable to a grid structure for guiding articles delivered to the grid structure from an article supply source into containers, the grid finger attachment assembly comprising:

an elongated body member having an upper end and a lower end;

a compressible resilient member projecting from said elongated body member proximate said upper end of said elongated body member; and a receiving member having first and second longitudinally extending members and spacer means disposed therebetween for spacing said first and second longitudinally extending members apart from one another, said spacer means defining a receiving recess for receiving said upper end of said elongated body member and said compressible resilient member, said spacer means providing upper and side abutment surfaces for contacting and restraining against movement said upper end of said elongated body member upon receipt of said elongated body member by said receiving recess; said receiving member having portions defining an aperture for receiving said compressible resilient member, such that upon receipt by said receiving recess of said upper end of said elongated body member and said compressible resilient member, said compressible resilient member is projectable through said aperture and engageable with said portions of said receiving member adjacent said aperture for fixedly retaining said elongated body member to said receiving member.

11. A grid finger assembly receivable in an opening of a grid structure for guiding articles delivered to the grid structure into containers, the grid finger assembly comprising:

a biasing member having an upper end;

at least one projection member projecting outwardly from said biasing member;

a compressible resilient member projecting from said upper end of said biasing member for projecting through the opening in the grid structure; and at least one longitudinally extending finger element for attachment adjacent said biasing member having an upper end contactable with said at least one projection member such that said at least one finger element is biased outward from said biasing element, said upper end of said finger element defining a receiving passage for receiving said compressible resilient member upon attachment of said at least one finger element adjacent said biasing member such that said compressible resilient member is projectable through both said receiving passage and the opening in the grid structure for fixedly retaining both said biasing member and said at least one finger element to the grid structure.

12. A grid finger assembly as set forth in claim 11, wherein said compressible resilient member includes a slot in said upper end of said biasing member, said slot forming at least one projectable resilient tab portion in said upper end of said biasing member.

13. A grid finger assembly as set forth in claim 11, including two projection members associated with said biasing member and two finger elements attachable adjacent said biasing member.

* * * * *